US009472857B2

(12) United States Patent
Kashino et al.

(10) Patent No.: US 9,472,857 B2
(45) Date of Patent: Oct. 18, 2016

(54) ANTENNA DEVICE

(71) Applicant: Panasonic Corporation, Osaka (JP)

(72) Inventors: Yuichi Kashino, Ishikawa (JP); Hiroyuki Uno, Ishikawa (JP); Suguru Fujita, Tokyo (JP); Ryosuke Shiozaki, Tokyo (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 93 days.

(21) Appl. No.: 14/390,176

(22) PCT Filed: Feb. 4, 2014

(86) PCT No.: PCT/JP2014/000597
§ 371 (c)(1),
(2) Date: Oct. 2, 2014

(87) PCT Pub. No.: WO2014/122925
PCT Pub. Date: Aug. 14, 2014

(65) Prior Publication Data

US 2015/0070235 A1 Mar. 12, 2015

(30) Foreign Application Priority Data

Feb. 5, 2013 (JP) ..... 2013-020536

(51) Int. Cl.
*H01Q 19/00* (2006.01)
*H01Q 19/30* (2006.01)
*H01Q 1/38* (2006.01)

(52) U.S. Cl.
CPC ..... *H01Q 19/30* (2013.01); *H01Q 1/38* (2013.01)

(58) Field of Classification Search
CPC ..... H01Q 1/38; H01Q 19/30
USPC ..... 343/818, 819, 815, 817
See application file for complete search history.

(56) References Cited

U.S. PATENT DOCUMENTS 4,479,130 A * 10/1984 Snyder ..... H01Q 9/16 343/802
2006/0061513 A1 3/2006 Sato (Continued)

FOREIGN PATENT DOCUMENTS

CN 102437416 A 5/2012
JP 2006-093878 A 4/2006

(Continued)

OTHER PUBLICATIONS

International Search Report for Application No. PCT/JP2014/000597 dated Apr. 28, 2014.

*Primary Examiner* — Dieu H Duong
(74) *Attorney, Agent, or Firm* — Pearne & Gordon LLP

(57) ABSTRACT

An antenna device includes a first substrate, a feeder line which is disposed in the first substrate, a grounding conductor which is disposed in the first substrate, a first radiation element which is electrically connected to the feeder line in the first substrate, a second radiation element which is electrically connected to the grounding conductor and is disposed substantially in parallel with the first radiation element in the first substrate, a first reflector which is disposed in the first substrate, and a second reflector which is disposed in the first substrate so as to be separated by a predetermined distance from the first radiation element or the second radiation element in at least one of longitudinal directions of the first radiation element and the second radiation element.

5 Claims, 11 Drawing Sheets

(56) References Cited

U.S. PATENT DOCUMENTS

| | | | | |
|---|---|---|---|---|
| 2007/0063056 | A1 | 3/2007 | Gaucher et al. | |
| 2011/0234467 | A1* | 9/2011 | Huang | H01Q 1/38 343/837 |
| 2012/0229356 | A1 | 9/2012 | Sudo et al. | |
| 2013/0027268 | A1 | 1/2013 | Ohno et al. | |

FOREIGN PATENT DOCUMENTS

| | | | |
|---|---|---|---|
| JP | 2009-200719 | A | 9/2009 |
| JP | 2012-120001 | A | 6/2012 |
| JP | 2012-191318 | A | 10/2012 |
| WO | 2012/164782 | A1 | 12/2012 |

* cited by examiner (A)

(B)

(A)

(B)

(C)

(A)

(B)

(C)

ANTENNA DEVICE

TECHNICAL FIELD

The present disclosure relates to an antenna device.

BACKGROUND ART

While reduction in power consumption is requested in portable wireless device, increase in antenna gain is requested in order to achieve remote distance communication with low power. As one of means for attaining increase in antenna gain, there is an array antenna in which a plurality of antennas are arrayed so that the directivity can be fixed to one direction by control of excitation phases of the respective antennas.

Of array antennas, an array antenna whose directivity is fixed to the array direction is called an end-fire array antenna. A Yagi array antenna which uses dipole type radiation elements, a reflector and a director is known as one of end-fire array antennas.

As to Yagi array antennas, for example, Patent Literature 1 discloses a Yagi array antenna. FIG. 10 is a view showing the configuration of the Yagi array antenna disclosed in Patent Literature 1. In the Yagi array antenna shown in FIG. 10, dipoles 901 and 902 serving as radiation elements and microstrip lines 903 and 904 feeding power to the dipoles 901 and 902 are printed in a substrate 900 consisting of a dielectric substrate.

A director 905 and a reflector 906 are printed at a distance from the dipole 901 in a first surface of the two surfaces of the substrate 900. A plane Yagi array antenna is comprised by the director 905, the reflector 906 and the dipoles 901 and 902. A tapered balun 907 connected to the micro-strip line 904 disposed in a second surface of the substrate 900 and a ground plane 908 connected to the tapered balun line 907 are printed in the second surface.

PRIOR ART LITERATURE

Patent Document

Patent Document 1: JP-A-2009-200719

SUMMARY OF THE INVENTION

Problem that the Invention is to Solve

In the Yagi array antenna disclosed in Patent Literature 1, the antenna gain may be decreased.

The present disclosure has been developed in consideration of the aforementioned circumstances. The present disclosure provides an antenna device capable of suppressing decrease in antenna gain.

Means for Solving the Problem

An antenna device according to the present disclosure includes: a first substrate, a feeding line which is disposed in the first substrate; a ground plane which is disposed in the first substrate; a first radiation element which is disposed in the first substrate so as to be electrically connected to the feeding line; a second radiation element which is disposed in the first substrate so as to extend substantially in parallel with the first radiation element and to be electrically connected to the ground plane; a first reflector which is disposed in the first substrate; and a second reflector which is disposed in the first substrate so as to extend in at least one of longitudinal directions of the first radiation element and the second radiation element and at a predetermined distance from the first radiation element or the second radiation element.

Advantage of the Invention

According to the present disclosure, it is possible to suppress decrease in antenna gain.

MODE FOR CARRYING OUT THE INVENTION

Embodiments of the present disclosure will be described below with reference to the drawings.

(Circumstances Leading to Achievement of Disclosed Mode)

In recent years, a space where internal parts of a portable wireless device can be disposed has been reduced with miniaturization of the portable wireless device. In addition, an antenna built in the portable wireless device is apt to be affected by an electric structure (also referred to as peripheral structure) disposed near the antenna. The peripheral structure includes, for example, a wiring pattern or a connector for external connection. High technology on design is required for designing the antenna in consideration of the peripheral structure so as to attain excellent antenna performance.

For example, when the Yagi array antenna disclosed in Patent Literature 1 is disposed in a portable wireless device, a remedial measure against decrease in antenna gain is requested because the directivity of the antenna is influenced due to set the peripheral structure.

In the following embodiments, description will be made about antenna devices capable of suppressing decrease in antenna gain.

The antenna devices in the following embodiments are used in wireless communication circuits for high frequencies (e.g. 60 GHz) in millimeter-wave bands, and mounted with various electronic parts (such as antennas and semiconductor chips). In addition, Yagi array antennas which are, for example, mounted on portable wireless device or radar device will be mainly described as the antenna devices by way of example.

(First Embodiment)

Figure 1:
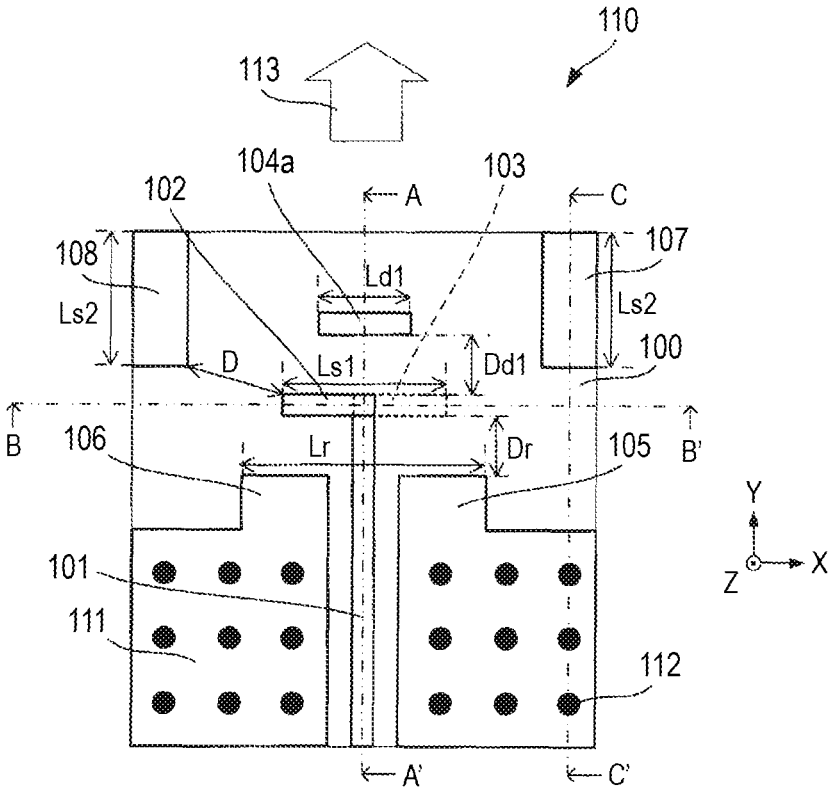
FIG. 1 Plan views showing a configuration example of a Yagi array antenna according to a first embodiment, of which views, (A) is a front view and (B) is a back view.
Figure 1:
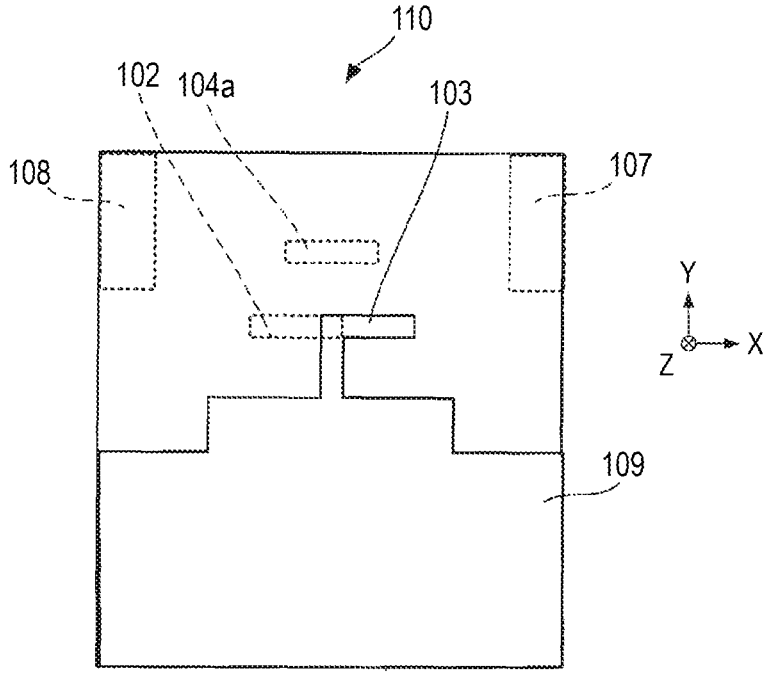
Figure 2:
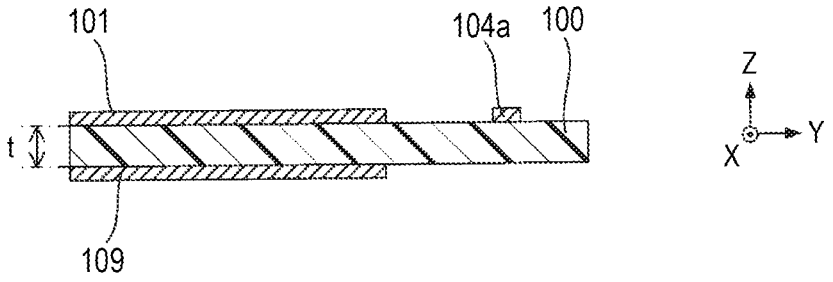
FIG. 2 Sectional views showing the configuration example of the Yagi array antenna according to the first embodiment, of which views, (A) is a side view (sectional view taken on line A-A'), (B) is a side view (sectional view taken on line B-B'), and (C) is a side view (sectional view taken on line C-C').
Figure 2:
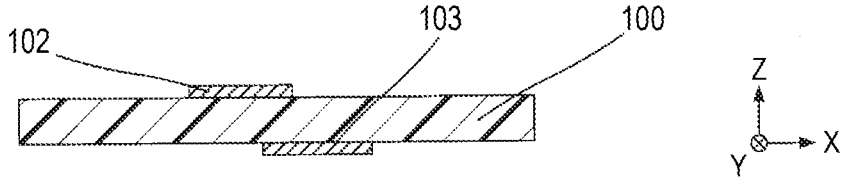
Figure 2:
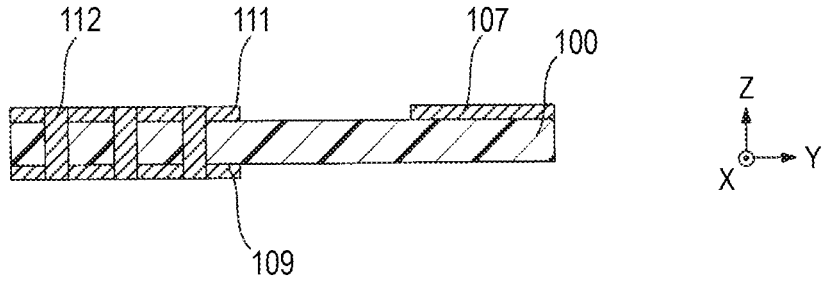

FIG. 1(A) to FIG. 1(B) and FIG. 2(A) to FIG. 2(C) are views showing a configuration example of a Yagi array antenna 110 according to a first embodiment. FIG. 1(A) is a front view showing the configuration example of the Yagi array antenna 110, and FIG. 1(B) is a back view showing the configuration example of the Yagi array antenna 110. FIG. 2(A) is a sectional view of the A-A' portion of FIG. 1(A), FIG. 2(B) is a sectional view of the B-B' portion of FIG. 1(A), and FIG. 2(C) is a sectional view of the C-C' portion of FIG. 1(A).

The Yagi array antenna 110 has a dielectric substrate 100, a feeding line 101, a first radiation element 102, a second radiation element 103, a first director 104*a*, first reflectors 105 and 106, and second reflectors 107 and 108.

The dielectric substrate 100 is, for example, a double-sided substrate with thickness t and a dielectric constant $\in r$. In one surface (+Z side, front side) of the dielectric substrate 100, a first ground plane 109 is formed, for example, out of a copper foil pattern. In the other surface (−Z side, back side) of the dielectric substrate 100, a second ground plane 111 is formed, for example, out of a copper foil pattern. The first grounding conductor 109 and the second grounding conductor 111 serve as ground.

In addition, a through hole 112 penetrating the first ground plane 109 and the second ground plane 111 is formed in the Yagi array antenna 110. The inner wall of the through hole 112 is, for example, plated with gold so as to electrically connect the first ground plane 109 and the second ground plane 111 with each other. In addition, the feeding line 101 is disposed on the same plane as the second ground plane 111 in the dielectric substrate 100. Thus, a coplanar line with the ground is constituted by use of the first ground plane 109, the second ground plane 111 and the feeding line 101.

The first radiation element 102 is connected to the feeding line 101. The second radiation element 103 is connected to the first ground plane 109 and disposed substantially in parallel with the first radiation element 102. Length Ls1 between an open end of the first radiation element 102 and an open-end of the second radiation element 103 is, for example, set at about ½λg, so that a dipole antenna can be formed by use of the first radiation element 102 and the second radiation element 103. Incidentally, "λg" designates an effective wavelength of a signal propagated through the feeding line 101, and shows a wavelength corresponding to the working frequency of the Yagi array antenna 110 in consideration of a wavelength shortening effect within the substrate.

The first director 104*a* is disposed on the same plane as the first radiation element 102 in the dielectric substrate 100. The first director 104*a* is disposed in a predetermined +Y direction position relative to the first radiation element 102 and substantially in parallel with the first radiation element 102 and the second radiation element 103. A distance Dd1 between the first director 104*a* and each of the first radiation element 102 and the second radiation element 103 is, for example, set at about ¼λg so that the first director 104*a* can operate as director. In addition, longitudinal direction length Ld1 of the first director 104*a* is, for example, set to be a little shorter than ½λg.

The Yagi array antenna 110 which includes the first director 104*a* is capable to increase the gain in the direction of the arrow 113. The direction of the arrow 113 designates the direction of directivity.

The first reflectors 105 and 106 are arranged in predetermined −Y direction positions relative to the first radiation element 102 by the second ground plane 111 which is partially formed into a convex shape. A distance Dr between each of the first radiation element 102 and the second radiation element 103 and each of the first reflectors 105 and 106 is, for example, set at about ¼λg so that the first reflectors 105 and 106 can operate as reflectors. In addition, Length Lr between opposite end portions of the first reflectors 105 and 106 is, for example, set to be a little longer than ½λg.

The Yagi array antenna 110 which includes the first reflectors 105 and 106 is capable to reflect radio waves radiated from the dipole antenna and to provide directivity in the direction (+Y direction) of the arrow 113.

The Yagi array antenna 110 is capable to attain radiation of radio waves in the +Y direction (direction of the arrow 113) due to the effect of the reflectors and the director obtained thus.

The second reflectors 107 and 108 are disposed on the same plane as the first radiation element 102 in the dielectric substrate 100. The second reflectors 107 and 108 are disposed at a predetermined distance D from the first radiation element 102 or the second radiation element 103 and substantially perpendicularly to the first radiation element 102 and the second radiation element 103 in the substrate surface.

Next, the effect by the second reflectors 107 and 108 will be described with reference to FIG. 3(A) to FIG. 3(C).

Figure 3:
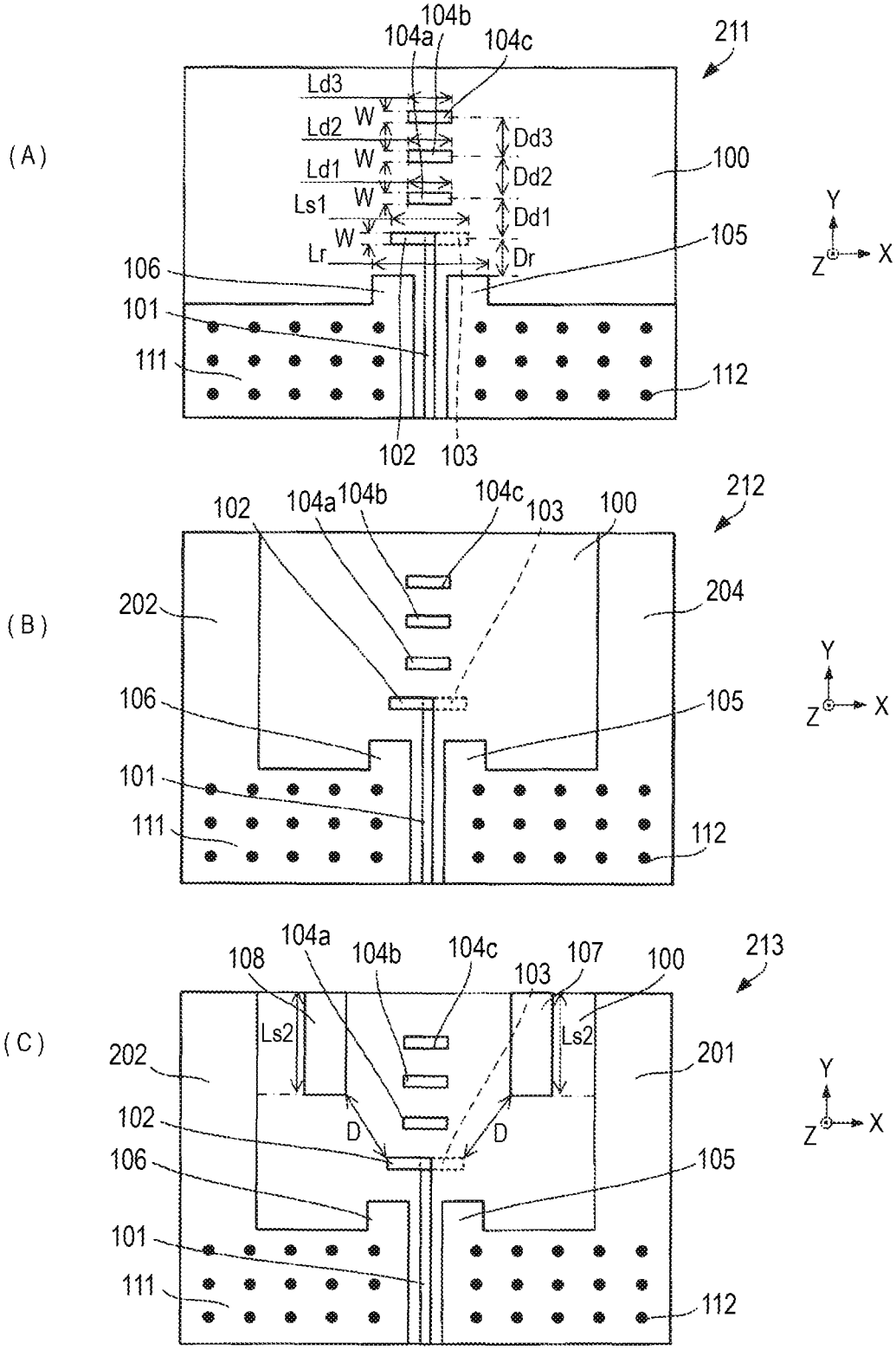
FIG. 3 Plan views showing configuration examples of Yagi array antennas for explaining the advantage of the first embodiment, of which views, (A) is a plan view showing a configuration where a peripheral structure and a second reflector are not comprised, (B) is a plan view showing a configuration where a peripheral structure is comprised, and (C) is a plan view showing a configuration where a peripheral structure and a second reflector are comprised.

FIG. 3(A) is a plan view showing a configuration example of a Yagi array antenna 211 which is not comprised with any peripheral structure and any second reflector. FIG. 3(B) is a plan view showing a configuration example of a Yagi array antenna 212 which is comprised with a peripheral structure but not comprised with any second reflector. FIG. 3(C) is a plan view showing a configuration example of a Yagi array antenna 213 which is comprised with a peripheral structure and second reflectors.

In the Yagi array antennas 211, 212 and 213, constituents the same as those in the Yagi array antenna 110 described previously are referenced correspondingly, and detailed description thereof will be omitted. As compared with the Yagi array antenna 110, the Yagi array antenna 211 does not include second reflectors, the Yagi array antenna 212 does not include second reflectors but has a peripheral structure added thereto, and the Yagi array antenna 213 has a peripheral structure added thereto.

Assume that each Yagi array antenna 211, 212, 213 is, for example, mounted on a portable wireless device, and comprised with a dielectric substrate 100 of a comparatively large size measuring at least one wavelength in the ±X direction and the ±Y direction. In addition, assume that a second director 104*b* and a third director 104*c* are disposed in each Yagi array antenna 211, 212, 213 in order to take into consideration practical use in the fundamental configuration of the Yagi array antenna 110 shown in FIG. 1.

Design dimensions resulting from the antenna performance of the Yagi array antenna 211 are shown in FIG. 3(A). The same design dimensions can be applied to the Yagi array antennas 212 and 213 in FIG. 3(B) and FIG. 3(C). Specific examples of the design dimensions will be described below.

thickness t of the dielectric substrate 100: 0.06λ dielectric constant ∈r of the dielectric substrate 100: 3.6 short direction (Y direction) length W of each of the first director 104*a*, the second director 104*b*, the third director 104*c*, the first radiation element 102 and the second radiation element 103: 0.03λ distance Dr between each of the first radiation element 102 and the second radiation element 103 and each of the first reflectors 105 and 106: 0.17λ distance Dd1 between the first radiation element 102 and the first director 104*a*: 0.17λ distance Dd2 between the first director 104*a* and the second director 104*b*: 0.3λ distance Dd3 between the second director 104*b* and the third director 104*c*: 0.3λ length Lr between opposite end portions of the first reflectors 105 and 106: 0.72λ length Ls1 between the open-end of the first radiation element 102 and the open-end of the second radiation element 103: 0.37λ longitudinal direction (X direction) length Ld1 of the first director 104*a*: 0.22λ longitudinal direction (X direction) length Ld2 of the second director 104*b*: 0.2λ longitudinal direction (X direction) length Ld3 of the third director 104*c*: 0.2λ

Incidentally, "λ" designates a free space wavelength corresponding to the working frequency of each Yagi array antenna 110, 211 to 213.

In the Yagi array antenna 212 in FIG. 3(B), ground patterns 201 and 202 are further added to the Yagi array antenna 211 in FIG. 3(A) and in its peripheral area. For example, the antenna has a configuration including the first radiation element 102, the second radiation element 103, the first director 104*a*, the second director 104*b*, the third director 104*c*, and the first reflectors 105 and 106.

In FIG. 3(B), ground patterns 201 and 202 are disposed at predetermined distances from the first radiation element 102 and the second radiation element 103 in the longitudinal directions of the first radiation element 102 and the second radiation element 103 so as to surround a part of the periphery of the antenna. The ground patterns 201 and 202 serve as an example of a peripheral structure.

In the Yagi array antenna 213 of FIG. 3(C), second reflectors 107 and 108 are added to the Yagi array antenna 212 of FIG. 3(B). Specific examples of design dimensions resulting from the antenna performance of the Yagi array antenna 213 will be described below.

longitudinal direction length Ls2 of each of the second reflectors 107 and 108: 0.3λ distance D between each of the second reflectors 107 and 108 and each of the first radiation element 102 and the second radiation element 103: 0.47λ

Next, the relationship between each Yagi array antenna 211 to 213 and the gain of the antenna will be described.

Figure 4:
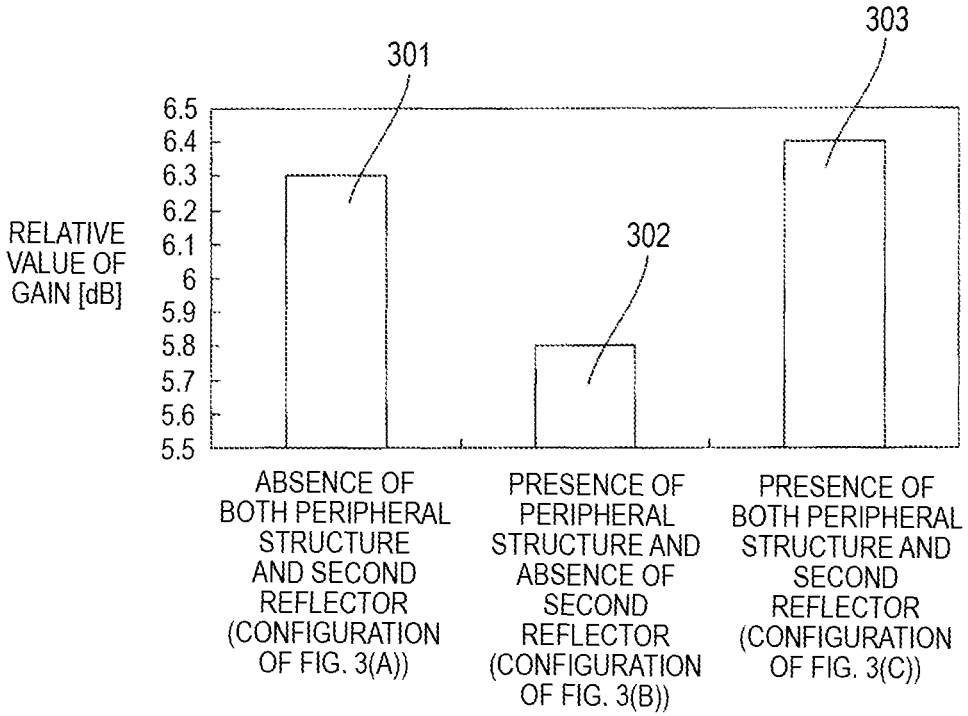
FIG. 4 A graph showing absolute values of gains in the configurations of the Yagi array antennas shown in FIG. 3(A) to FIG. 3(C) respectively.

FIG. 4 shows the antenna gain in the configuration of each Yagi array antenna 211 to 213.

With reference to FIG. 4, it is possible to confirm that the gain of the Yagi array antenna 212 which is comprised with a peripheral structure (for example, the ground patterns 201 and 202) is lower than the gain of the Yagi array antenna 211 which is not comprised with the peripheral structure. This is because the antenna characteristic deteriorates due to the influence of the peripheral structure.

It is possible to also confirm that the gain of the Yagi array antenna 213 which is comprised with the peripheral structure and the second reflectors 107 and 108 is higher than the gain of the Yagi array antenna 212 which is not comprised with the second reflectors 107 and 108. This is because the deterioration in gain caused by the influence of the peripheral structure is capable to be suppressed by the second reflectors 107 and 108.

That is, from comparison between a gain 301 and a gain 302 in FIG. 4, it is possible to understand that the gain is lowered by disposing the ground patterns 201 and 202 in the periphery of the antenna. On the other hand, from comparison between the gain 302 and a gain 303 in FIG. 4, it is possible to understand that the gain is improved by the arrangement of the second reflectors 107 and 108.

Figure 5:
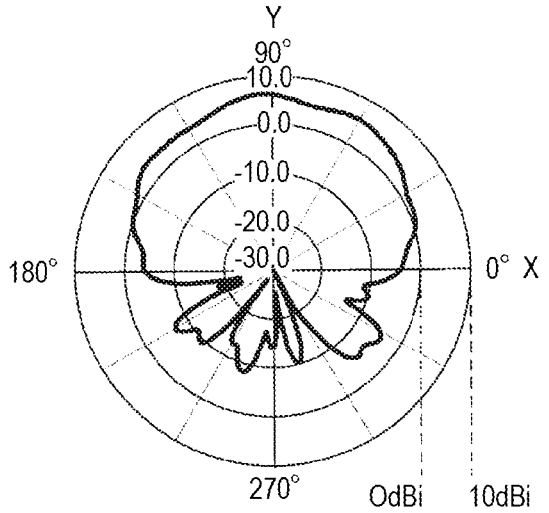
FIGS. 5 (A) to (C) are schematic views showing planes of Eϕ component radiation patterns on an XY-plane in the configurations of the Yagi array antennas shown in FIG. 3(A) to FIG. 3(C) respectively.
Figure 5:
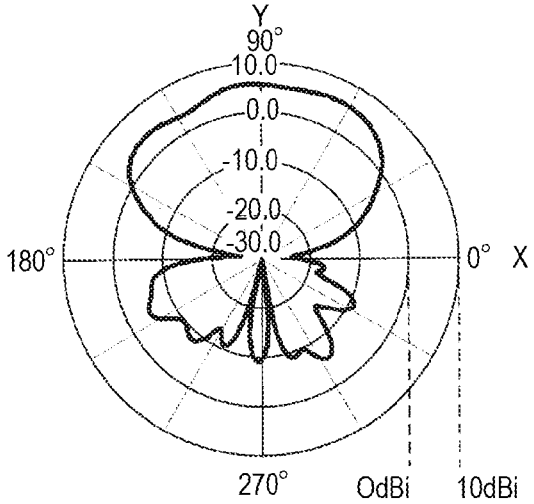
Figure 5:
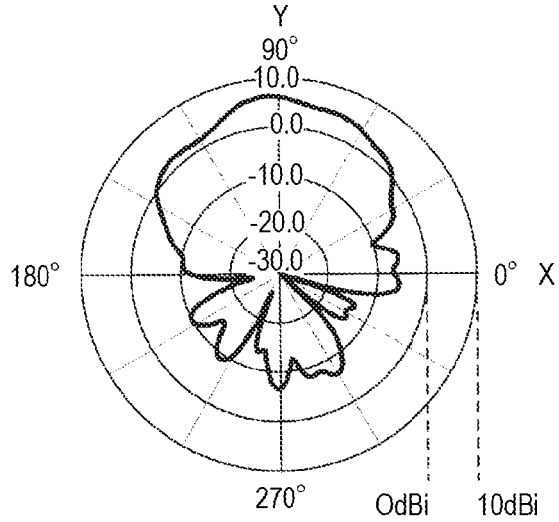

FIG. 5(A) to FIG. 5(C) show examples of Eϕ component (horizontal polarized wave component) radiation patterns on an XY-plane. FIG. 5(A) shows a radiation pattern of the Yagi array antenna 211. FIG. 5(B) shows a radiation pattern of the Yagi array antenna 212. FIG. 5(C) shows a radiation pattern of the Yagi array antenna 213.

As shown in FIG. 5(B) and FIG. 5(C), the Yagi array antenna 212 and 213 which is disposed the second reflectors 107 and 108, are capable to reduce radiation of radio waves in directions of about 45 degrees and about 135 degrees, to narrow the directivity around the direction of the arrow 113, and to increase the gain. In addition, the Yagi array antenna 212 and 213 are capable to reduce the radiation in the substantially ±X directions by narrowing the directivity. Accordingly, for example, as shown in FIG. 3(B), the Yagi array antenna 213 is capable to reduce the influence of a peripheral structure (such as wiring patterns or ground patterns) disposed in the substantially ±X directions, and to obtain a high gain.

Furthermore, the Yagi array antenna is capable to obtain the aforementioned effect of the second reflectors 107 and 108 even when the number of directors changes. The gain becomes higher as the number of directors increases.

Next, the relationship between the longitudinal direction length Ls2 of each second reflector 107, 108 and the gain will be described.

Figure 6:
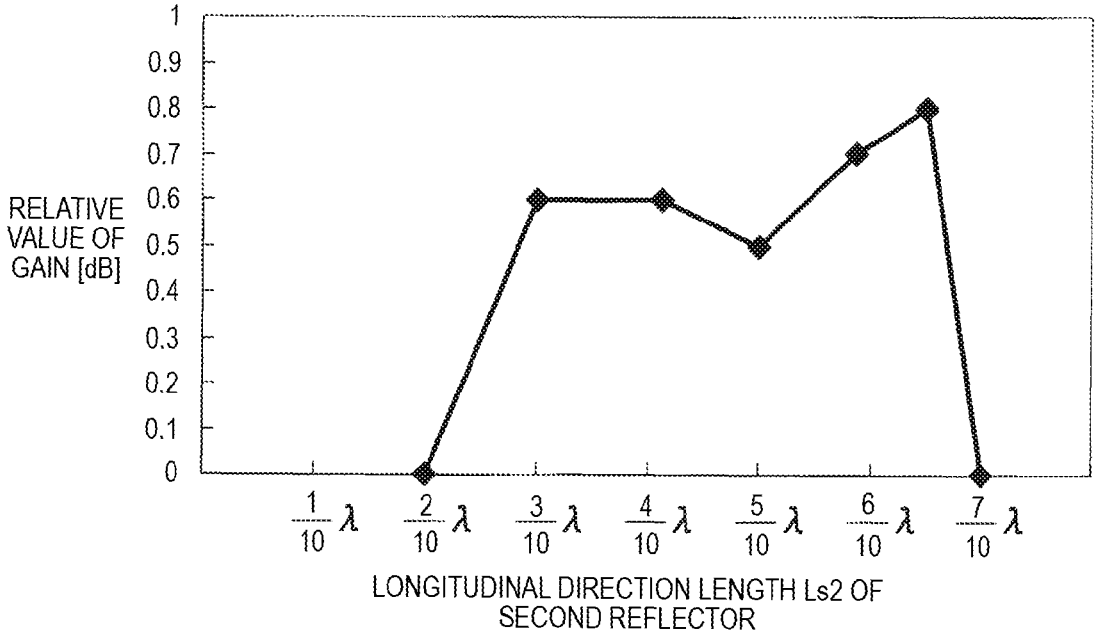
FIG. 6 A schematic graph showing a relative value of a gain to the longitudinal direction length of a second reflector in the Yagi array antenna according to the first embodiment.

FIG. 6 shows a relative value of the gain in the Yagi array antenna 213 when the longitudinal direction length Ls2 of each second reflector 107, 108 is changed. The relative value designates the gain ratio of the Yagi array antenna 213 to the Yagi array antenna 212 when the gain in the Yagi array antenna 212 is regarded as 0 dB.

In FIG. 6, the gain in the Yagi array antenna 213 is higher than the gain in the Yagi array antenna 212 because the second reflectors 107 and 108 operate as reflectors in a range where the length Ls2 is larger than 2/10λ and smaller than 7/10λ. Thus, the Yagi array antenna 213 is capable to obtain the improved antenna gain effect even when the length Ls2 is not ½λ.

Next, the relationship between the gain and the distance D between each of the second reflectors 107 and 108 and each of the first radiation element 102 and the second radiation element 103 will be described.

Figure 7:
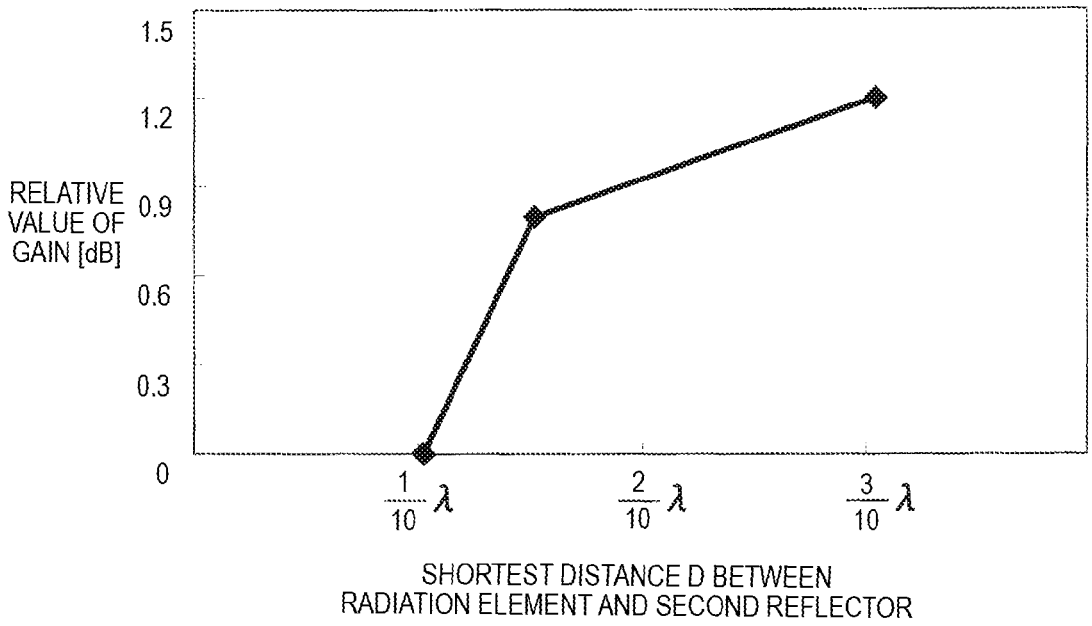
FIG. 7 A schematic graph showing a relative value of a gain to a distance between a radiation element and the second reflector in a plane array antenna according to the first embodiment.

FIG. 7 shows a relative value of the gain in the Yagi array antenna 213 when the distance D between each of the second reflectors 107 and 108 and each of the first radiation element 102 and the second radiation element 103 is changed. The relative value designates the gain ratio of the Yagi array antenna 213 to the Yagi array antenna 212 when the gain in the Yagi array antenna 212 is regarded as 0 dB.

As shown in FIG. 7, the gain in the Yagi array antenna 213 is higher than the gain in the Yagi array antenna 212 when the distance D is larger than 1/10λ. This is because the second reflectors 107 and 108 made of metal are at a certain distance from the first radiation element 102 and the second radiation element 103. The Yagi array antenna 213 is capable to suppress the decrease in radiation resistance of the antenna, the decrease in radiation efficiency of the antenna, and the decrease in gain of the antenna. In this case, the Yagi array antenna 213 is capable to obtain a higher gain improving effect than the Yagi array antenna 212.

According to the Yagi array antenna 110 or 213, each second reflector 107, 108 is disposed at a predetermined distance from the first radiation element 102 or the second radiation element 103 and, for example, substantially perpendicular to the first director 104*a* so as to reduce the influence of a peripheral structure and obtain a high gain of the antenna. In addition, the Yagi array antenna 110, 213 may suppress an adverse effect of the peripheral structure on the radiation pattern and the deterioration of the gain even when Yagi array antenna 110, 213 is so small in size and the mounting density of electronic parts is high.

(Second Embodiment)

This embodiment assumes that an antenna apparatus is mounted on another apparatus (for example, portable wireless device).

Figure 8:
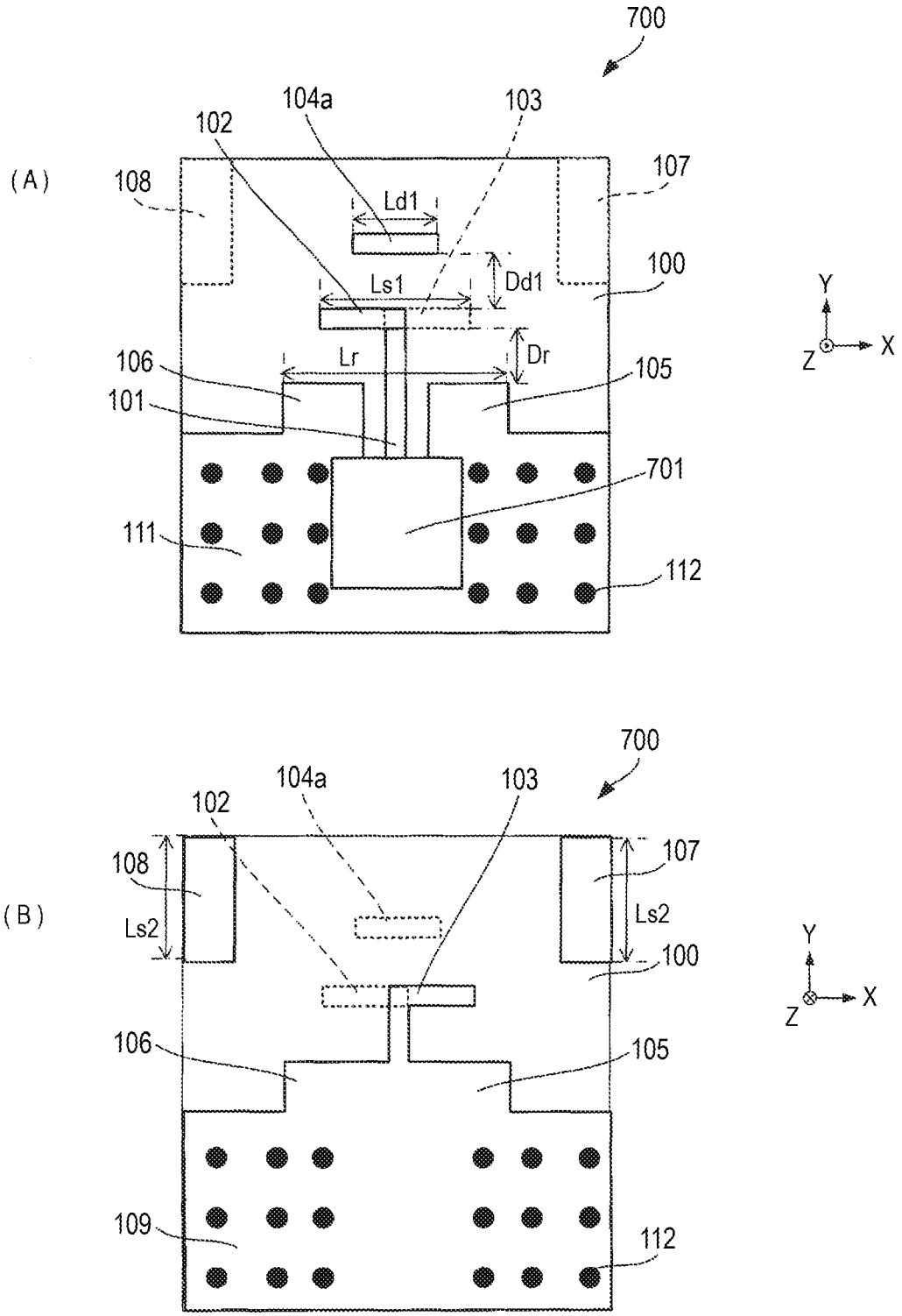
FIG. 8 Plan views showing a configuration example of a Yagi array antenna according to a second embodiment, of which views, (A) is a front view, and (B) is a back view.

FIG. 8(A) and FIG. 8(B) are plan views showing a configuration example of a Yagi array antenna 700 according to the second embodiment. FIG. 8(A) is a front view showing the configuration example of the Yagi array antenna 700, and FIG. 8(B) is a back view showing the configuration example of the Yagi array antenna 700. In FIG. 8(A) and FIG. 8(B), constituent parts the same as those in the Yagi array antenna 110 according to the first embodiment are referenced correspondingly, and detail description thereof will be omitted.

The Yagi array antenna 700 has a radio unit 701 connected to the feeding line 101 in the Yagi array antenna 110 shown in the first embodiment. In addition, the second reflectors 107 and 108 are disposed on the same plane as the first ground plane 109, that is, on the other surface of the dielectric substrate 100. The second reflectors 107 and 108 may be disposed on the one surface of the dielectric substrate 100.

When the radio unit 701 is comprised, the Yagi array antenna 700 is possible to operate as a radio communication module.

Figure 11:
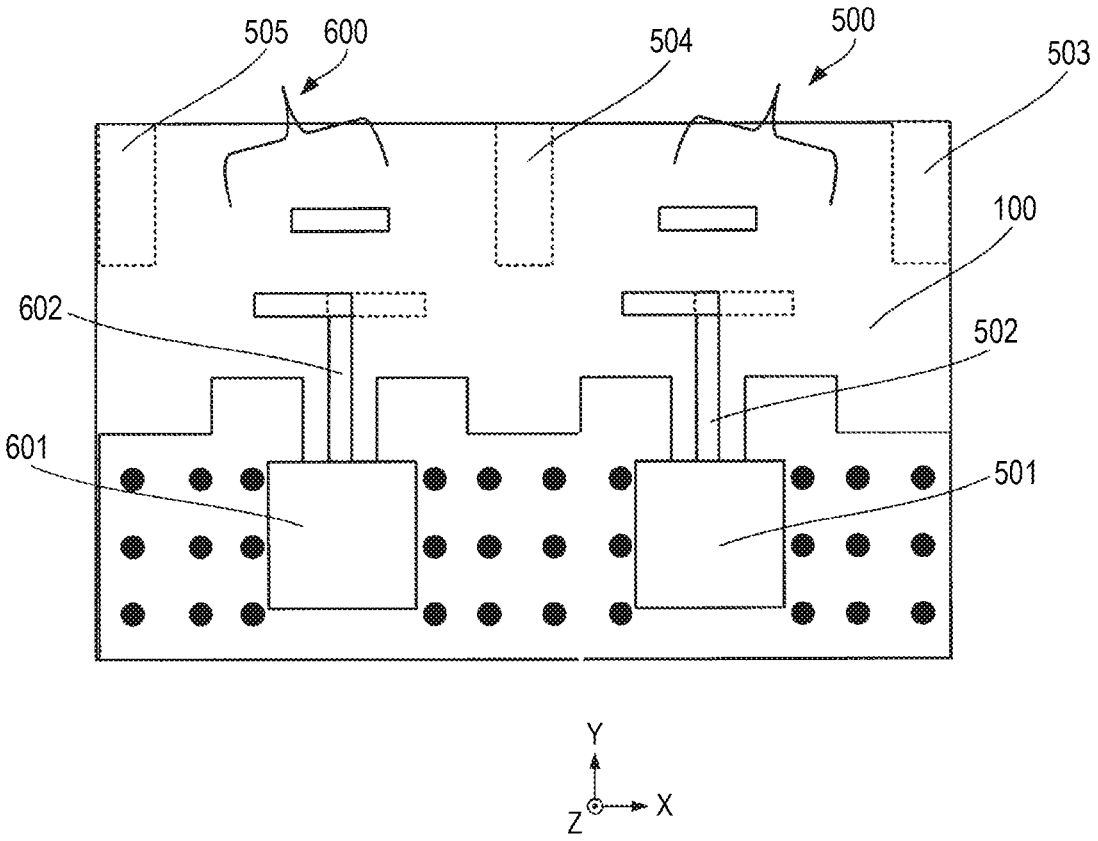
FIG. 11 A plan view showing a configuration where the Yagi array antenna according to the second embodiment is applied to an application of communication.

FIG. 11 shows an example in which the Yagi array antenna 700 shown in FIG. 8(A) and FIG. 8(B) is applied to an application of communication. In FIG. 11, a transmitting Yagi array antenna 500 and a receiving Yagi array antenna 600 are disposed on the dielectric substrate 100. Although the transmitting Yagi array antenna 500 and the receiving Yagi array antenna 600 are formed into the same shape in FIG. 11, the two antennas do not have to be formed into the same shape.

The transmitting Yagi array antenna 500 is connected to a transmitter 501 with a feeding line 502. The receiving Yagi array antenna 600 is connected to a receiver 601 with a feeding line 602.

Second reflectors 503, 504 and 505 are disposed on the both ends of the transmitting Yagi array antenna 500 and the both ends of the receiving Yagi array antenna 600. The second reflector 504 performs as a reflector for both the transmitting Yagi array antenna 500 and the receiving Yagi array antenna 600.

Thus, the Yagi array antenna 700 applied to the application of communication as shown in FIG. 11 is also capable to obtain a similar effect of the Yagi array antennas in FIG. 1, FIG. 3(A) to FIG. 3(C) and FIG. 8(A) to FIG. 8(B).

Incidentally, the second reflector 504 does not have to be formed into the same shape as the second reflectors 503 and 505, but may be omitted.

Figure 9:
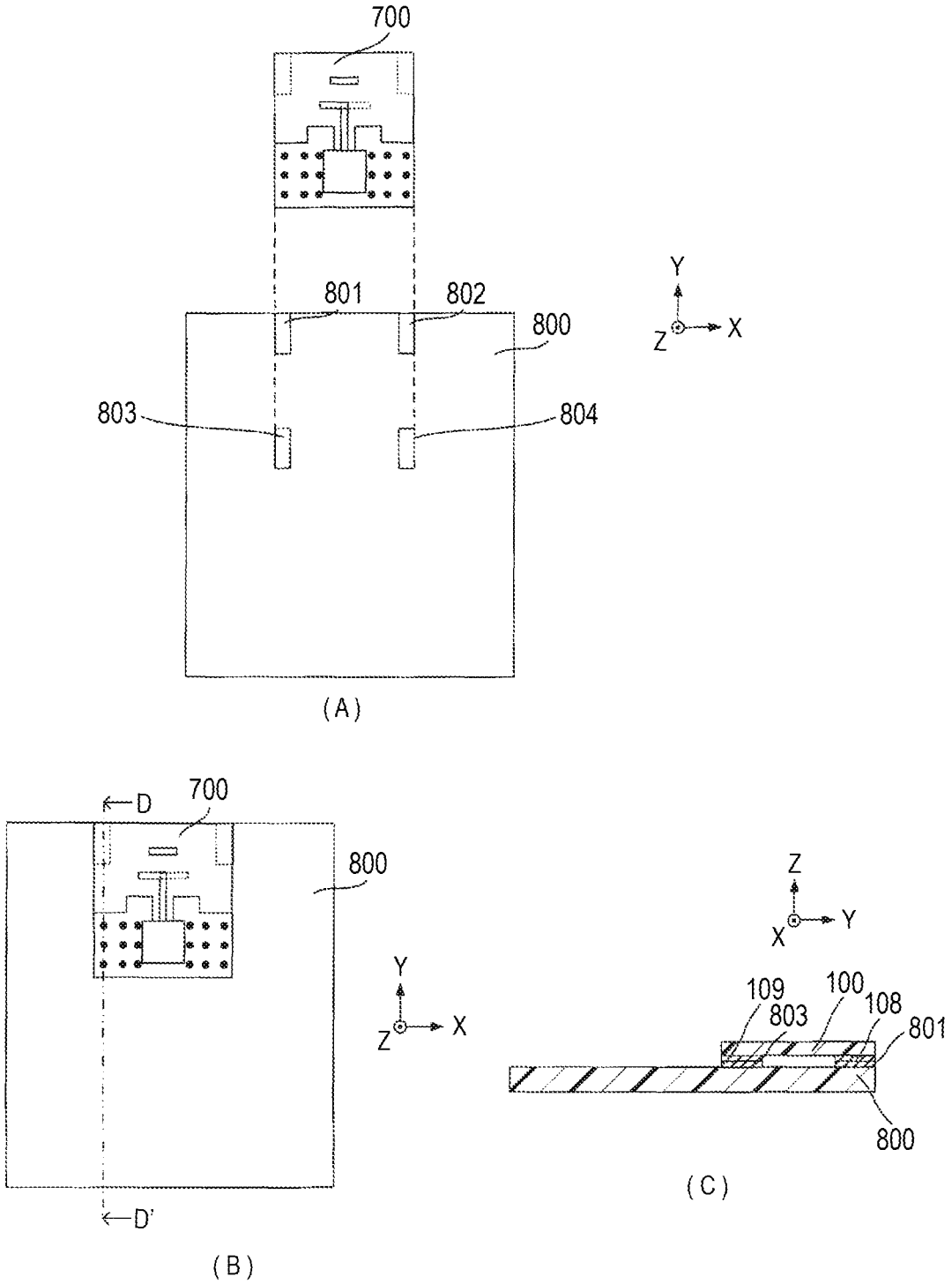
FIG. 9 Views showing a configuration example of the Yagi array antenna according to the second embodiment disposed on another dielectric substrate, of which views, (A) is a plan view showing the configuration example in which the Yagi array antenna and the dielectric substrate are illustrated individually, (B) is a plan view showing the configuration example in which the Yagi array antenna is disposed on the dielectric substrate, and (C) is a D-D' plan view showing the configuration example in which the Yagi array antenna is disposed on the dielectric substrate.
Figure 10:
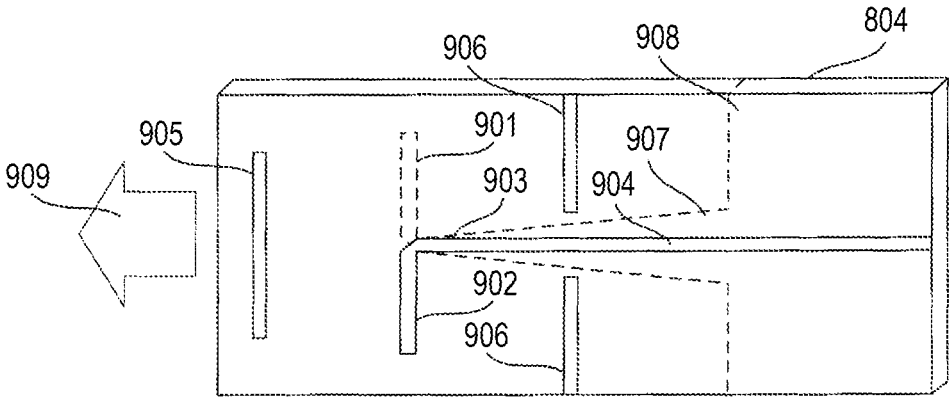
FIG. 10 A view showing a Yagi array antenna disclosed in Patent Literature 1.

FIG. 9(A) to FIG. 9(C) show a configuration example of the Yagi array antenna 700 disposed on a dielectric substrate 800 mounted on a portable wireless device. FIG. 9(A) is a plan view showing the Yagi array antenna 700 and the dielectric substrate 800 individually. FIG. 9(B) is a plan view in which the Yagi array antenna 700 is disposed on the dielectric substrate 800. FIG. 9(C) is a sectional view taken on the D-D' portion of FIG. 8(B).

A first connection area 801, a second connection area 802, a third connection area 803 and a fourth connection area 804 formed out of copper foil patterns are disposed on one surface (+Z side) of the dielectric substrate 800. In this manner, the dielectric substrate 100 and the dielectric substrate 800 are connected with the connection areas (lands) located at the four points of the substrate corner areas so as to improve the mounting strength.

The pattern shapes of the first connection area 801 and the second connection area 802 are, for example, substantially identical to the shapes of the second reflectors 107 and 108 in the Yagi array antenna 700. In addition, the dielectric substrate 100 and the dielectric substrate 800 may be formed out of the same material or different materials. For example, the dielectric substrate 100 and the dielectric substrate 800 are formed out of glass epoxy resin.

In a connection process between the Yagi array antenna 700 and the dielectric substrate 800, the first connection area 801 is superimposed on the second reflector 108, the second connection area 802 is superimposed on the second reflector 107, and the third connection area 803 and the second connection area 804 are superimposed on the first ground plane 109, as shown in FIG. 9(C). Then, the superimposed areas are soldered in a reflow process. Thus, the Yagi array antenna 700 is connected to the dielectric substrate 800 and mounted thereon.

In this manner, the second reflectors 107 and 108 are electrically or physically connected to connection areas (for example, the first connection area 801 and the second connection area 802). Thus, the Yagi array antenna 700 mounted on another apparatus (for example, a portable wireless device) is capable to obtain a similar effect of the Yagi array antenna 110 according to the first embodiment.

In addition, the dielectric substrate 100 on which an antenna is disposed and the dielectric substrate 800 which is disposed on a portable wireless device may be configured separately. These configurations eliminate the need to provide a specific design for the antenna in accordance with the material and the thickness of the dielectric substrate which is mounted on the portable wireless device. Thus, the versatility of antenna is improved.

In addition, the second reflectors 107 and 108 may be also used as the connection areas with the dielectric substrate 800. This configuration eliminate the need to dispose another copper foil pattern for connection on the dielectric substrate 100. Thus, the design of antenna becomes easy.

In this manner, according to the Yagi array antenna 700, when the Yagi array antenna is mounted on various portable wireless device, an antenna substrate (dielectric substrate) for the Yagi array antenna is comprised by using different dielectric substrate from a dielectric substrate for a portable wireless device. Thus, the versatility of the Yagi array antenna is improved.

For example, due to the antenna substrate which is comprised by using different dielectric substrate, specific optimization for obtaining a desired antenna characteristic is capable to be dispensed with even when there is a difference in material or thickness of a dielectric substrate used for a portable wireless device in accordance with the model or the maker of the portable wireless device. It is therefore possible to universally mount the Yagi array antenna on various portable wireless device.

In addition, when the second reflectors 107 and 108 are also used as connection members to another substrate (for example, the dielectric substrate 800 for the portable wireless device), connection to the other substrate is capable to be made easier.

In addition, when copper foil patterns are disposed as lands on a dielectric substrate for a Yagi array antenna and a dielectric substrate for a portable wireless device in order to connect the Yagi array antenna to the portable wireless device, the copper foil patterns as a peripheral structure may give an adverse effect to the antenna characteristic. The Yagi array antenna 700 may be reduced the influence of the peripheral structure and suppress the deterioration of the gain.

Incidentally, the present disclosure is not limited to the aforementioned configurations of the embodiments, but it can be applied to any configuration as long as the configuration can achieve the functions shown in the claims or the functions belonging to the configurations of the embodiments.

For example, although the second reflectors 107 and 108 are disposed in both the +X directions and −X directions in each of the Yagi array antennas 110 and 213 according to the aforementioned embodiments, the second reflector 107 or 108 may be disposed on at least one direction, that is, the +X direction or the −X direction. In this case, the influence of a peripheral structure on the side where the second reflector 107 or 108 is disposed is capable to be suppressed.

In addition, although the second reflectors 107 and 108 and the second ground plane 111 are disposed on the same plane in each of the Yagi array antennas 110 and 213, the Yagi array antenna is capable to obtain a similar effect even when the second reflectors 107 and 108 and the first ground plane 109 are disposed on the same plane. Further, the second reflectors 107 and 108 may be disposed on the both sides of the dielectric substrate 100.

In addition, in each of the Yagi array antennas 110 and 213, the first radiation element 102 is disposed on one surface of the dielectric substrate 100 and the second radiation element 103 is disposed on the other surface of the dielectric substrate 100. However, the two radiation elements may be disposed on the same surface.

In addition, although rectangles are exemplified as the shapes of the second reflectors 107 and 108 in each of the Yagi array antennas 110 and 213, the second reflectors 107 and 108 may be formed into other shapes than rectangles. For example, the second reflectors 107 and 108 may be conductive members having longitudinal components, such as elliptic conductive members.

In addition, although a Yagi array antenna is exemplified as an antenna apparatus in each of the aforementioned embodiments, another antenna apparatus may be used.

In addition, although the Yagi array antenna having at least one director is exemplified in each of the aforementioned embodiments, the director may be omitted. The Yagi array antenna is capable to suppress to decrease in antenna gain even when the director is omitted.

The present application is based on Japanese Patent Application No. 2013-020536 filed on Feb. 5, 2013, the contents of which are incorporated herein by reference.

(Summary of Embodiments of the Disclosure)

A first antenna apparatus according to the present disclosure includes:

a first substrate;

a feeding line which is disposed in the first substrate;

a ground plane which is disposed in the first substrate;

a first radiation element which is electrically connected to the feeding line in the first substrate;

a second radiation element which is electrically connected to the ground plane and is disposed substantially in parallel with the first radiation element in the first substrate;

a first reflector which is disposed in the first substrate; and a second reflector which is disposed in the first substrate and is separated by a predetermined distance from the first radiation element or the second radiation element in at least one of longitudinal directions of the first radiation element and the second radiation element.

A second antenna apparatus of the present disclosure according to the first antenna device, further includes:

a director which is disposed in the first substrate and is separated by a predetermined distance from the first radiation element and is disposed on an opposite side to the first reflector with respect to the first radiation element.

A third antenna apparatus of the present invention according to the first or second antenna apparatus, further includes:

a radio unit; wherein:

the radio unit is electrically connected to the feeding line.

A fourth antenna apparatus of the present disclosure according to any one of the first to third antenna apparatus, wherein:

the antenna device is mounted in a wireless device; and the second reflector is electrically or physically connected to a connection area which is disposed in a second substrate provided in the wireless device.

A fifth antenna apparatus of the present disclosure according to any one of the first to fourth antenna apparatus, wherein:

a longitudinal direction length of the second reflector has an electric length which is longer than 2/10 of a wavelength of a usage frequency of the antenna apparatus and shorter than 7/10 of the wavelength.

A sixth antenna apparatus of the present disclosure according to any one of the first to fifth antenna apparatus, wherein:

a distance between the second reflector and the first radiation element or the second radiation element has an electric length which is longer than 1/10 of a wavelength of a working frequency of the antenna apparatus.

INDUSTRIAL APPLICABILITY

The present disclosure is useful for an antenna apparatus or the like capable of suppressing decrease in antenna gain.

DESCRIPTION OF REFERENCE NUMERALS AND SIGNS

100 dielectric substrate
101 feeding line
102 first radiation element
103 second radiation element
104*a* to 104*c* director
105, 106 first reflector
107, 108 second reflector
109 first ground plane
110, 211, 212, 213, 700 Yagi array antenna
111 second ground plane
112 through hole
201, 202 ground pattern
301, 302, 303 relative value of gain
500 transmitting Yagi array antenna
501 transmitter
502 feeding line
503, 504, 505 second reflector
600 receiving Yagi array antenna
601 receiver
602 feeding line
701 radio unit
800 dielectric substrate
801 first connection area
802 second connection area
803 third connection area
804 fourth connection area

What is claimed is:

1. An antenna apparatus comprising:
a first substrate;
a feeding line which is disposed in the first substrate;
a ground plane which is disposed in the first substrate;
a first radiation element which is electrically connected to the feeding line in the first substrate;
a second radiation element which is electrically connected to the ground plane and is disposed in parallel with the first radiation element in the first substrate;
a first reflector which is disposed in the first substrate;
a second reflector which is disposed in the first substrate and is separated by a predetermined distance from the first radiation element or the second radiation element in at least one of longitudinal directions of the first radiation element and the second radiation element; and
a director which is disposed in the first substrate and is separated by a predetermined distance from the first radiation element and is disposed on an opposite side to the first reflector with respect to the first radiation element,
wherein the second reflector is disposed at a position so that a longitudinal direction of the second reflector and the longitudinal direction of the first radiation element are perpendicular to each other.

2. The antenna apparatus according to claim 1, further comprising:
a radio unit; wherein:
the radio unit is electrically connected to the feeding line.

3. The antenna apparatus according to claim 1, wherein:
the antenna apparatus is mounted on a wireless device; and
the second reflector is electrically or physically connected to a connection area which is disposed in a second substrate provided in the wireless device.

4. The antenna apparatus according to claim 1, wherein:
a longitudinal direction length of the second reflector has an electric length which is longer than 2/10 of a wavelength of a usage frequency of the antenna apparatus and shorter than 7/10 of the wavelength.

5. The antenna apparatus according to claim 1, wherein:
a distance between the second reflector and the first radiation element or the second radiation element has an electric length which is longer than 1/10 of a wavelength of a working frequency of the antenna apparatus and shorter than 3/10 of the wavelength.

* * * * *